US008241059B2

(12) United States Patent
Huang et al.

(10) Patent No.: US 8,241,059 B2
(45) Date of Patent: Aug. 14, 2012

(54) ELECTRICAL CONNECTOR AND PRINTED CIRCUIT BOARD ASSEMBLY

(75) Inventors: Wei-Chao Huang, Taipei Hsien (TW); Chih-Ming Huang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 160 days.

(21) Appl. No.: 12/792,910

(22) Filed: Jun. 3, 2010

(65) Prior Publication Data

US 2011/0237121 A1 Sep. 29, 2011

(30) Foreign Application Priority Data

Mar. 26, 2010 (TW) ..... 99109270 A

(51) Int. Cl.
*H01R 13/621* (2006.01)

(52) U.S. Cl. ..... 439/574; 439/573

(58) Field of Classification Search ..... 439/574, 439/573, 571, 563, 564, 570, 553
See application file for complete search history.

(56) References Cited

U.S. PATENT DOCUMENTS

| | | | | | |
|---|---|---|---|---|---|
| 5,066,246 | A * | 11/1991 | Jensik | 439/562 |
| 5,228,865 | A * | 7/1993 | Douty et al. | 439/247 |
| 5,622,520 | A * | 4/1997 | Dutka et al. | 439/573 |
| 5,993,252 | A * | 11/1999 | Laurx | 439/573 |
| 6,004,157 | A * | 12/1999 | Glass | 439/574 |
| 6,086,418 | A * | 7/2000 | Chang | 439/573 |
| 6,102,735 | A * | 8/2000 | Chen et al. | 439/573 |
| 6,346,007 | B2 * | 2/2002 | Yokoi | 439/564 |
| 6,827,606 | B2 * | 12/2004 | Endoh | 439/573 |
| 6,884,112 | B1 * | 4/2005 | Juntwait et al. | 439/573 |
| 2006/0205271 | A1 * | 9/2006 | Hsu | 439/573 |

* cited by examiner

*Primary Examiner* — Gary F. Paumen
(74) *Attorney, Agent, or Firm* — Altis Law Group, Inc.

(57) ABSTRACT

A connector and printed circuit board assembly includes a printed circuit board, a connector fixed on the printed circuit board, and a fixing board fixed on the connector, the fixing board defining a through hole, a connecting member fixed on the printed circuit board adjacent to the connector, a threaded retainer, and a threaded post securely connected with the connecting member. The threaded post passes through the through hole and seats the threaded retainer to lock the connector onto the printed circuit board.

11 Claims, 3 Drawing Sheets

ELECTRICAL CONNECTOR AND PRINTED CIRCUIT BOARD ASSEMBLY

BACKGROUND

1. Technical Field

The present disclosure relates to a connector and printed circuit board assembly.

2. Description of the Related Art

A connector and printed circuit board assembly includes a connector and a printed circuit board. The connector may include a housing, a plug formed on the housing and a fixing post extending perpendicular to the housing. The printed circuit board forms a receptacle receiving the plug and defines a receiving hole for receiving the fixing post. The plug is received in the receptacle, and the fixing post is received in the receiving hole to prevent movement of the connector relative to the printed circuit board.

However, since the fixing post is typically formed on the housing of the connector, if the fixing post is broken, the entire connector must be replaced. This can be expensive. Further, the fixing post compromises the adaptability of the connector, since a printed circuit board must provide the receiving hole therefor in order to be compatible therewith.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views, and both the views are schematic.

DETAILED DESCRIPTION

Figure 1:
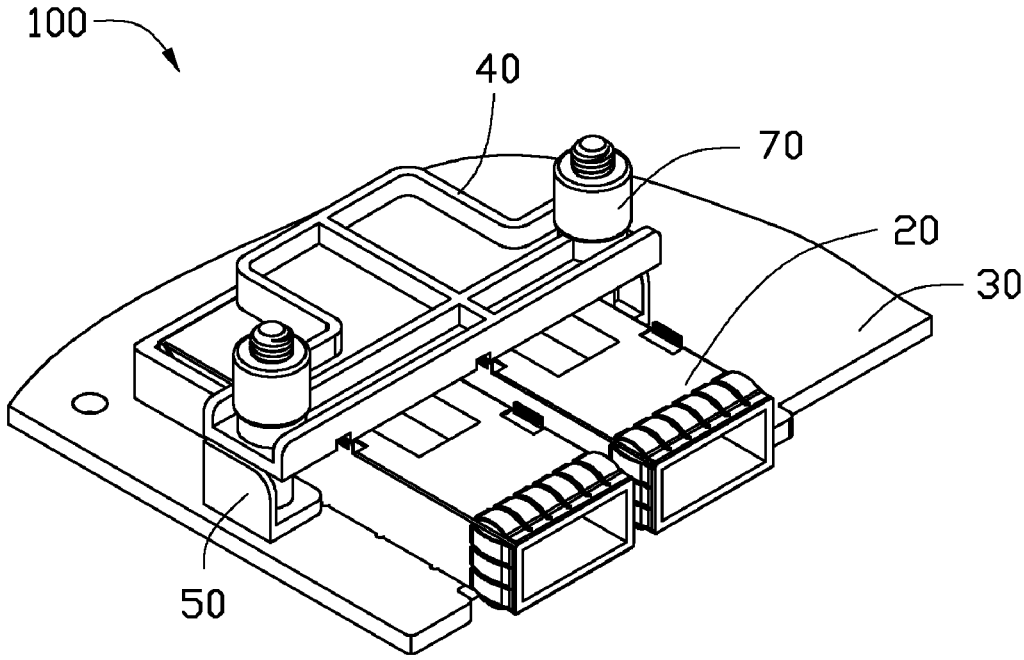
FIG. 1 is an isometric view of a first exemplary embodiment of a connector and printed circuit board assembly.
Figure 2:
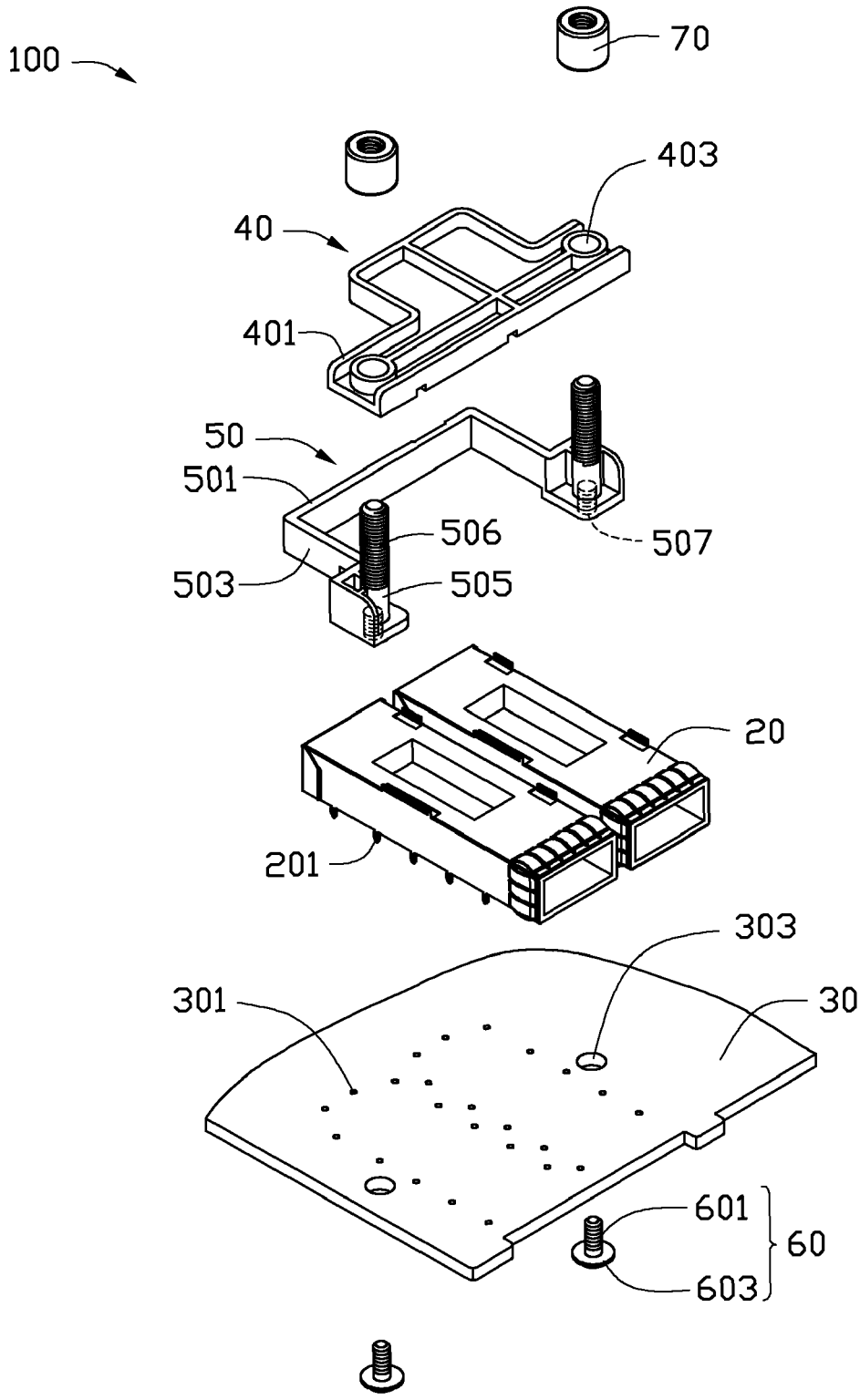
FIG. 2 is an exploded, isometric view of the connector and printed circuit board assembly of FIG. 1.

Referring to FIGS. 1 and 2, an exemplary embodiment of a connector and printed circuit board assembly 100 includes two connectors 20, a printed circuit board 30, a fixing board 40, a connecting member 50, two fasteners 60 and two threaded retainers 70. The connector 20 can be substantially rectangular, and includes a plurality of pins 201 on a bottom surface thereof. The printed circuit board 30 defines a plurality of pin holes 301 corresponding to the pins 201 and two fixing holes 303. The pin holes 301 are between the two fixing holes 303, receiving the pins 201. In the illustrated exemplary embodiment, the connector 20 is a quad small form factor pluggable (QSFP) connector.

The connecting member 50 can be substantially U-shaped and includes a base portion 501 and two extending portions 503. The two extending portions 503 are parallel and coplanar and extend from opposite ends of the base portion respectively. Each extending portion 503 forms a threaded post 505 in an end thereof. The threaded post 505 defines an outer thread 506 at its distal end. The threaded post 505 defines a threaded hole 507 at its proximal end.

The fastener 60 includes a threaded portion 601 corresponding to the threaded hole 507 of the threaded post 505 and a head portion 603 at an end of the threaded portion 601.

The two connectors 20 are positioned side by side on the printed circuit board 30, and each pin 201 is received in a pin hole 301, fixing the connectors 20 on the printed circuit board 30. The fixing member 50 is positioned on the printed circuit board 30, and the threaded post 505 faces the printed circuit board 30. Each threaded hole 507 is aligned with each fixing hole 303 of the printed circuit board 30. The threaded portion 601 passes through the fixing hole 303 and is received in the threaded hole 507 of threaded post 505. The head portion 603 abuts the printed circuit board 30, to fix the connecting member 50 to the printed circuit board 30. The base portion 501 and the extending portion 503 surround the ends of the two connectors 20, thereby protecting and securing thereof on the printed circuit board 30. The fixing board 40 is positioned on the connector 20, with each threaded post 505 passing through the through hole 403 and partially protruding from the fixing board 40. Each threaded retainer 70 is threaded onto one threaded post 505, thus pressing the fixing board 40 to fix the connector 20 to the printed circuit board 30.

The connector and printed circuit board assembly 100 includes the connecting member 50 and fixing board 40 to lock the connector 20 on and secure positioning thereof to the printed circuit board 30. In case of failure or breakage, fixing board 40 and connecting member 50 can be replaced individually, reducing in maintenance costs. The connecting member 50 and the fixing board 40 are not a part of the connector 20, which maintains universal compatibility, allowing mounted on a commonly used printed circuit board 30. In the assembly process, the connecting member 50 is mounted on the printed circuit board 30, allowing easy assembly of the connector and printed circuit board assembly 100.

It is understood that the connecting member 50 may be fixed on the printed circuit board 30 by adhesion or welding.

Figure 3:
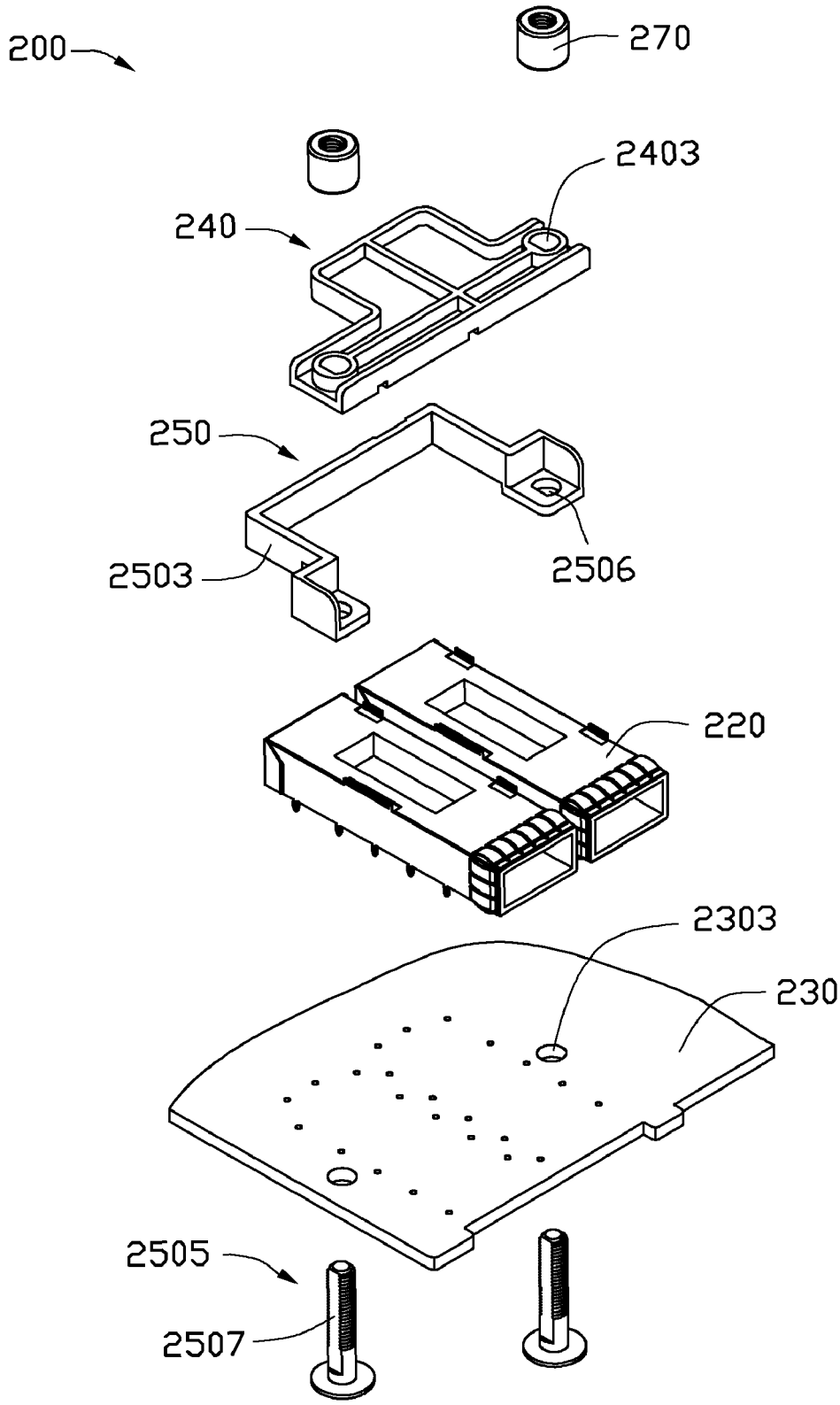
FIG. 3 is an exploded, isometric view of a second exemplary embodiment of a connector and printed circuit board assembly.

Referring to the FIG. 3, a second exemplary embodiment of the connector and printed circuit board assembly 200 differs from printed circuit board assembly 100 in that threaded post 2505 is an individual member; and each extending portion 2503 of the connecting member 250 defines a stopping hole 2506. The threaded post 2505 passes through the fixing hole 2303, stopping hole 2506 and the through hole 2403 in that order, and finally seats the threaded retainer 270. The connecting member 250 without threaded post 2505 formed thereon can be easily manufactured. In the illustrated exemplary embodiment, the threaded post 2505 is partly cut, forming a stopping surface 2507. The through hole 2403 is non-circular correspondingly, to prevent rotation of the threaded post 2505 in the through hole 2403 in assembly process.

Finally, while particular exemplary embodiments have been described, the description is illustrative and is not to be construed as limiting. For example, various modifications can be made to the exemplary embodiments by those of ordinary skill in the art without departing from the true spirit and scope of the invention as defined by the appended claims.

What is claimed is:

1. An electrical connector and printed circuit board assembly comprising:

a printed circuit board;

an electrical connector fixed on the printed circuit board;

a fixing board positioned on the electrical connector, the fixing board defining at least one through hole;

a connecting member fixed on the printed circuit board and partially surrounding the electrical connector;

at least one threaded retainer;

at least one threaded post securely connected with the connecting member and the at least one threaded post passing through the at least one through hole and engaging with the at least one threaded retainer, to lock the electrical connector on the printed circuit board.

2. The electrical connector and printed circuit board assembly of claim 1, further comprising a fastener, the printed circuit board defines a fixing hole, the connecting member defines a threaded hole, and the fastener passes through the fixing hole and threadedly engages in the threaded hole, to fix the connecting member on the printed circuit board.

3. The electrical connector and printed circuit board assembly of claim 1, wherein the connecting member is welded on the printed circuit board.

4. The electrical connector and printed circuit board assembly of claim 1, wherein the connecting member is glued on the printed circuit.

5. The electrical connector and printed circuit board assembly of claim 1, wherein threaded posts are positioned on each side of the connector respectively.

6. The electrical connector and printed circuit board assembly of claim 5, wherein the connecting member comprises a base portion and an extending portion formed at each end of a base portion, wherein the base portion and the extending portions partially surround the connector, and each threaded post is formed on an end of the extending portion spaced from the base portion.

7. The electrical connector and printed circuit board assembly of claim 5, wherein the connecting member comprises a base portion and an extending portion formed at each end of the base portion, the base portion and the extending portions partially surrounding the electrical connector, wherein each extending portion defines a stopping hole at an end spaced from the base portion, through holes correspond to the threaded posts each threaded post passes through one stopping hole, one though hole and then seated on a threaded retainer, thereby locking the fixing board, the electrical connector and the connecting member together.

8. The electrical connector and printed circuit board assembly of claim 7, wherein the threaded post forms a cross-section having a stopping surface and the cross-section of the stopping hole is non-circular corresponding to the threaded post.

9. An electrical connector and printed circuit board assembly comprising:

a printed circuit board;

an electrical connector fixed on the printed circuit board;

a fixing board positioned on the electrical connector, the fixing board defining a through hole;

a connecting member fixed on the printed circuit board, adjacent to the electrical connector, by a fastener;

threaded retainers;

threaded posts formed on the connecting member, each threaded post passing through the through hole and seating with the threaded retainer, thereby locking the electrical connector onto the printed circuit board.

10. The electrical connector and printed circuit board assembly of claim 9, wherein the printed circuit board defines a fixing hole through which the fastener passes, the connecting member defines a threaded hole receiving the fastener, and the fastener passes through the fixing hole and is received in the threaded hole, to fix the connecting member onto the printed circuit board.

11. The electrical connector and printed circuit board assembly of claim 9, wherein the connecting member comprises a base portion and extending portions, wherein each extending portion is formed at an end of the base portion, the base portion and the extending portions partly surround the electrical connector, and each threaded post is formed on an end of the extending portion spaced from the base portion.

* * * * *